US007178468B2

(12) United States Patent
Winter et al.

(10) Patent No.: US 7,178,468 B2
(45) Date of Patent: Feb. 20, 2007

(54) TABLE

(75) Inventors: David C. Winter, Layton, UT (US); Robert A. Astle, Farmington, UT (US); S. Curtis Nye, Clinton, UT (US); Kent Ashby, Logan, UT (US); L. Curtis Strong, Clearfield, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/949,777

(22) Filed: Sep. 24, 2004

(65) Prior Publication Data

US 2005/0087108 A1 Apr. 28, 2005

Related U.S. Application Data

(63) Continuation-in-part of application No. 29/192,259, filed on Oct. 20, 2003, now Pat. No. Des. 499,283.

(60) Provisional application No. 60/513,161, filed on Oct. 20, 2003.

(51) Int. Cl.
*A47B 3/00* (2006.01)

(52) U.S. Cl. ..... 108/27; 108/91; 108/901; 108/129

(58) Field of Classification Search ..... 108/27, 108/91, 125, 126, 129, 130, 131, 132, 901; 248/345.1, 188; 211/126.7
See application file for complete search history.

(56) References Cited

U.S. PATENT DOCUMENTS

D107,152 S 11/1937 Jackson
D116,560 S 9/1939 Hoffman
2,709,632 A * 5/1955 Mahr ..... 52/782.21
2,730,418 A * 1/1956 Blink ..... 108/169
2,889,185 A * 6/1959 Heisler ..... 108/91
3,093,095 A * 6/1963 Howe et al. ..... 108/131
3,410,232 A * 11/1968 Bills et al. ..... 108/146
3,416,468 A * 12/1968 Peterson et al. ..... 108/131
3,875,712 A * 4/1975 Thompson ..... 52/263
4,011,821 A * 3/1977 Neal ..... 108/156
D264,419 S 5/1982 Dorman et al.
4,727,816 A * 3/1988 Virtue ..... 108/91
4,841,877 A * 6/1989 Virtue ..... 108/36
5,311,825 A * 5/1994 Bonham ..... 108/27
5,483,904 A * 1/1996 Kelly et al. ..... 108/156
5,732,637 A * 3/1998 Raab ..... 108/129
5,868,081 A * 2/1999 Raab ..... 108/161
5,947,037 A * 9/1999 Hornberger et al. ..... 108/115
6,112,674 A 9/2000 Stanford (Continued)

*Primary Examiner*—Janet M. Wilkens
(74) *Attorney, Agent, or Firm*—Workman Nydegger

(57) ABSTRACT

A table may include a table top, a frame and one or more support members such as legs. Advantageously, the table top may include a generally planar upper surface and a generally planar lower surface. In particular, the lower surface of the table top may be substantially free of any downwardly extending projections such as a lip. Desirably, the table includes a frame and at least a portion of the frame is exposed and visible when the table is being used. In addition, the table may include one or more guard members that are sized and configured to protect portions of the table, such as the corners. Significantly, the guard members may be selectively connected to the table top or the frame, which may allow the guard members to be repaired or replaced.

4 Claims, 8 Drawing Sheets

U.S. PATENT DOCUMENTS

| | | | | |
|---|---|---|---|---|
| D489,557 | S | 5/2004 | Strong et al. | |
| D499,283 | S | 12/2004 | Winter et al. | |
| 6,837,171 | B1 * | 1/2005 | Clark et al. | 108/131 |
| 2003/0106474 | A1 | 6/2003 | Buono | |
| 2003/0127028 | A1 | 7/2003 | Baik et al. | |
| 2003/0217676 | A1 | 11/2003 | Strong et al. | |
| 2003/0221595 | A1 * | 12/2003 | Reinsch et al. | 108/91 |
| 2005/0022701 | A1 * | 2/2005 | Choi et al. | 108/131 |

* cited by examiner

TABLE

CROSS-REFERENCE TO RELATED APPLICATIONS

This application claims the benefit of and priority to U.S. Provisional Patent Application Ser. No. 60/513,161, filed Oct. 20, 2003, entitled TABLE. This application is a continuation-in-part of U.S. Design patent application Ser. No. 29/192,259, filed Oct. 20, 2003 now U.S. Pat. No. D499, 283, entitled TABLE TOP WITH EXPOSED PORTIONS OF THE FRAME. The disclosures of each of these applications are hereby incorporated by reference herein in their entireties.

BACKGROUND OF THE INVENTION

1. Field of the Invention

The present invention generally relates to furniture and, in particular, to tables.

2. Description of Related Art

Conventional tables are used for a variety of purposes and come in a wide array of designs. Conventional tables often include table tops constructed from wood, particle board or metal. Table tops constructed from wood, particle board or metal, however, are often relatively heavy and this may make the table awkward or difficult to move. Conventional table tops constructed from wood or metal are also relatively expensive and the table tops must generally be treated or finished before use. For example, table tops constructed from wood must generally be sanded and painted, and metal table tops must be formed into the desired shape and painted. In addition, these relatively heavy table tops may increase the cost of transportation, shipping and storage of the tables.

In order to decrease the weight of conventional tables, table tops can be constructed from relatively thin, light-weight materials. Disadvantageously, these light-weight table tops frequently require reinforcing members or other structural parts such as frames, railings, brackets and the like to strengthen the table top. These additional parts may increase the strength of the table top, but these additional parts may also increase the weight of the table. In addition, these additional parts may increase manufacturing costs and require additional time to assemble the table. Furthermore, these additional parts may have sharp edges that can injure the user's legs, arms or other body parts.

BRIEF SUMMARY OF EMBODIMENTS OF THE INVENTION

A need therefore exists for a table that eliminates the above-described and/or other disadvantages and problems.

One aspect is a table that may be relatively lightweight, which may allow the table to be more easily transported and moved. For example, the table may include a lightweight table top that reduces the overall weight of the table. The table may also include a lightweight frame that is connected to and may support the table top. In addition, the table may include lightweight legs that support the table top above a surface such as the ground or a floor. Significantly, if the table includes a lightweight table top, frame and legs, then a lightweight table to be constructed. Of course, a relatively lightweight table may be constructed with a lightweight table top, frame and/or legs, as desired.

Another aspect is a table that may includes legs which are movable between a use position and a storage position. The legs preferably extend outwardly from the table top in the use position, and the legs support the table top above a surface such as the floor. In the storage position, the legs are preferably collapsed into a relatively compact area, which allows the table to be easily transported or stored. The legs, for example, may be placed adjacent, parallel and/or proximate to the bottom surface of the table top in the collapsed position.

Yet another aspect is a table that may include a table top constructed from a lightweight material. Advantageously, the lightweight table top may allow a table to be created that is easily portable and can be readily lifted and moved by a single person. Desirably, the table top is constructed from blow-molded plastic, such as high density polyethylene. The blow-molded plastic table top may provide a rigid, high-strength structure that is capable of withstanding repeated use and wear. In addition, the blow-molded table top may be easily manufactured and formed into the desired size and shape.

A further aspect is a table that may include a frame and at least a portion of the frame may be exposed to the user. For example, the frame may include one or more portions, such as side rails, that extend along at least a portion of the length of the table. Desirably, the frame includes two side rails that are disposed along opposing edges or sides of the table. In particular, the side rails may be generally aligned with the sides of the table or the side rails may be spaced inwardly from the sides of the table to allow, for example, the edge of the table top to be grasped or held. This may allow the table to be easily moved or transported. The frame may also include one or more portions, such as end rails, that are disposed along the ends of the table top. Thus, the frame may be disposed about the perimeter or outer edges of the table.

Advantageously, if at least a portion of the frame is exposed, that may indicate to the user or purchaser that the table has increased strength and/or rigidity than a conventional table. Thus, the exposed frame may create a perception of a stronger table. In addition, if the frame is disposed along the outer edges of the table top, the frame may provide increased support for the edges or extremities of the table top. Therefore, the frame may be used to create a stronger and/or more rigid table. Further, if the frame is disposed along the outer edges of the table top, then the frame may help prevent the table top from being damaged. For example, the frame may absorb impacts or forces because it is disposed about the perimeter of the table top that otherwise would be applied directly to the table top. Accordingly, the frame may also help protect the table top from being dented, damaged or broken.

In addition, if at least a portion of the frame is exposed, that may create a table with improved aesthetics and style. For example, the exposed frame may provide a color contrast with the table top. That is, the table top may be one color and the frame may have a different color in order to create a table with a stylized appearance.

Still another aspect is a table that may include a frame attached to the outer edges of the table top to allow, for example, wider table legs to be used in connection with the table. For example, the table may include two side rails that are disposed along the sides of the table and the table legs may be disposed between the side rails when the legs are in the collapsed position. Advantageously, because the side rails may be disposed along the edges of the table top, the legs may have a width that is approximately equal to or slightly less than the width of the table top. Thus, for example, the legs could include two support portions that are disposed proximate the edges of the table and the support portions could be separated by a distance that is approximately equal to or slightly smaller than the width of the table top. The legs could also have a foot that has a length that is approximately equal to or slightly smaller than the width of the table top. Advantageously, because the legs may have a width and/or a foot that has a length that is approximately equal to the width of the table top, that may allow a very sturdy and stable table to be created.

Yet another aspect is a table that may include a table top with a generally planar lower surface. For example, the table may include a table top that does not include a generally downwardly extending portion or lip that may be used to attach the frame to the table top. This may make the table top easier to manufacture if it does not include any downwardly extending projections. In addition, it may decrease the amount of plastic or other material used to create the table top.

Another aspect is a table that may include one or more corner guards. Advantageously, the corner guards may help protect the exposed portions of the frame or other portions of the table from damage that can occur, for example, from dropping the table. The corner guards may also be replaceable and/or repairable. Thus, if the corner guard is damaged, then it may be replaced or repaired. Significantly, the corner guards may be replaced or repaired by the consumer, retailer or manufacturer. In addition, the corner guards may aid in attaching the frame to the table top and the corner guards may allow the frame to be securely attached to the table. The corner guards may also allow a skirt or other objects to be easily connected to the table. Further, the corner guards may facilitate stacking and/or nesting of the tables. Finally, the corner guards may be used to create a table with a particular style or design. For example, the corner guards may be used to provide a color contrast with the table top and/or the frame. This may allow a table with improved aesthetics and appearance to be created.

Yet another aspect is a table that may include a table top that is sized and configured to protect one or more exposed portions of the frame from damage. For example, the table top may include one or more sides or edges that are sized and configured to extend past the side or edges of the frame. Accordingly, the table top may absorb some or all of the stresses or forces applied to the table, which may prevent the frame from being damaged. In particular, because the table top may be constructed from relatively durable and resilient materials, such as blow molded plastic, the table top may help prevent the frame from being damaged. Thus, the table top may help protect the exposed portions of the frame from damage, which may be particularly advantageously if the exposed portions of the frame have painted or finished surfaces because even minor impacts can leave significant scars or other visible blemishes on the painted or finished surfaces. Further, because damage to the table top may be less noticeable than damage to the frame, it may be desirable to use the table top to help protect the frame from damage. Finally, because the table top may be sized and configured to minimize or otherwise reduce the visible damage to the frame, that may help keeping the table looking like new.

Still yet another aspect is a table that may include one or more legs attached to the table top. The legs, for example, may have a pedestal style. Significantly, the pedestal style legs may help hide the braces from view and these legs may allow a table with a more pleasing aesthetics or appearance to be created. The legs may also be sized and configured to provide increased leg room and space under the table. Additionally, the legs could be adjustable in height, if desired.

A further aspect is a table may include a table top constructed from plastic and the plastic table top may be formed into the desired shape and size by blow molding. Advantageously, a blow molded plastic table top may be quickly and efficiently manufactured. Desirably, the blow molded table top may include two opposing walls that are spaced apart a predetermined distance, which may increase the strength and rigidity of the table top. The blow-molded table top may also include one or more depressions or tack-offs, and the depressions may be designed to increase the strength of the table top and/or interconnect the spaced apart walls. Significantly, the blow molded table top may be light-weight, durable, generally weather resistant and temperature insensitive. In addition, the blow molded table top generally does not corrode, rust or otherwise deteriorate over time. The blow-molded table top can also be formed in various shapes, sizes, configurations and designs.

A still further aspect is the table may be relatively straight-forward to assemble. Advantageously, this may allow the table to be quickly and easily manufactured. In addition, this may allow the table to be shipped in an unassembled configuration and the consumer may be able to assemble the table. This may allow manufacturing and shipping costs to be decreased.

Another aspect is the table may include components that can be quickly and easily manufactured. For example, the lower portion of the table top may have a generally planar construction, which may simplify the manufacturing process and allow the table top to be quickly and easily manufactured. In addition, the legs and/or frame may be quickly and easily attached to the table top, which may reduce manufacturing costs.

Still another aspect is a table that may include a table top constructed from blow molded plastic and including a hollow interior portion that is formed during the blow molding process, the table top including a first side and an opposing second side. The table may also include a frame including a first side rail with an outer surface and a second side rail with an outer surface, the outer surface of the first side rail being generally aligned with the first side of the table top, the outer surface of the second side rail being generally aligned with the second side of the table top. In addition, the table may include at least one support member movable relative to the table top between an extended position in which the support member generally extends outwardly from the table top and a collapsed position in which the support member is generally positioned between the side rails of the frame.

Yet another aspect is a table that may include a table top constructed from blow molded plastic and including a hollow interior portion that is formed during the blow molding process, the table top including an upper surface, a lower surface, a first side and a second side; a first support member movable relative to the table top between a first position in which the first support member extends outwardly from the table top and a second position in which the first support member is positioned proximate the lower surface of the table top; a second support member movable relative to the table top between a first position in which the second support member extends outwardly from the table top and a second position in which the second support member is positioned proximate the lower surface of the table top; a first side rail connected to the table top and being generally aligned with the first side of the table top; and a second side rail connected to the table top and being generally aligned with the second side of the table top. The table may also include a plurality of depressions formed in the lower surface of the table top and extending towards the upper surface of the table top. In addition, the table may include a lower surface of the table top that is substantially free from downwardly extending protrusions. Further, the upper surface of the table top may be spaced apart at a generally constant distance from the lower surface of the table top.

A further aspect is a table that may include a table top constructed from blow molded plastic and including a hollow interior portion that is formed during the blow molding process, the table top including an upper surface, a lower surface, a first side, a second side, first end and a second end; a first support member movable relative to the table top between a first position in which the first support member extends outwardly from the table top and a second position in which the first support member is positioned proximate the lower surface of the table top; and a second support member movable relative to the table top between a first position in which the second support member extends outwardly from the table top and a second position in which the second support member is positioned proximate the lower surface of the table top. The table may also include a first side rail generally aligned with the first side of the table top, a second side rail generally aligned with the second side of the table top, a first end rail generally aligned with the first end of the table tops, a second end rail generally aligned with the second end of the table top, a first guard member connecting the first side rail and the first end rail, a second guard member connecting the second side rail and the first end rail, a third guard member connecting the first side rail and the second end rail, and a forth guard member connecting the second side rail and the second end rail. Advantageously, the guard members may be selectively attached to the first side rail and the second side rail. In addition, the lower surface of the table top may not include any generally downwardly extending projections. Further, the table may include a first crossbar that connects the first support member to the table top and a second crossbar that connects the second support member to the table top. The first crossbar and the second crossbar may also connect the first side rail and the second side rail to the table top.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

The present invention is generally directed towards a table with legs that are movable between an extended position and a collapsed position relative to a tabletop. The principles of the present invention, however, are not limited to tables with legs that are movable between extended and collapsed positions relative to a tabletop. It will be understood that, in light of the present disclosure, the table disclosed herein can be successfully used in connection with other types of furniture and equipment.

Additionally, to assist in the description of the table, words such as top, bottom, front, rear, right and left may be used to describe the accompanying figures. It will be appreciated, however, that the present invention can be located in a variety of desired positions—including various angles, sideways and even upside down. A detailed description of the table now follows.

Figure 1:
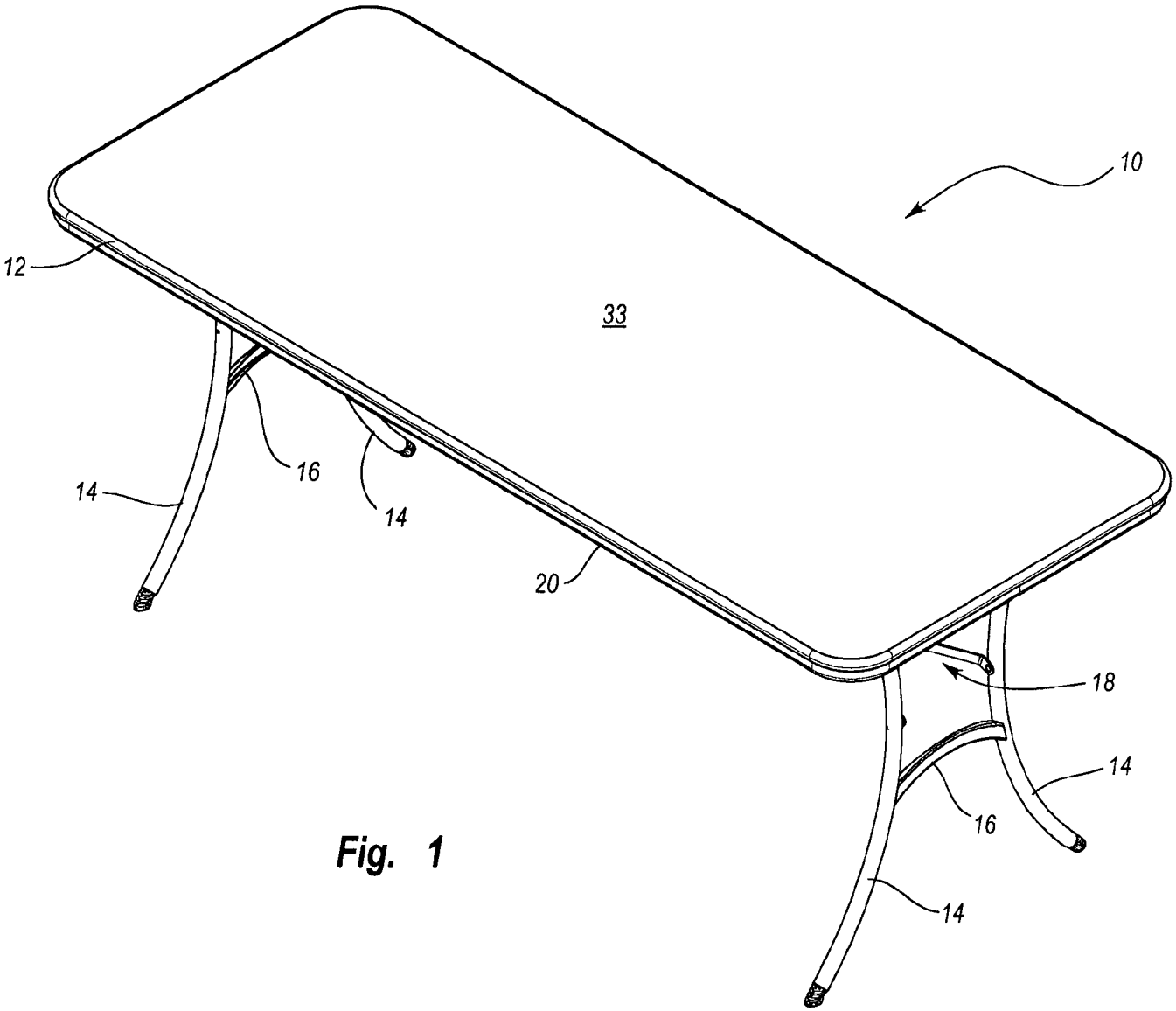
FIG. 1 is a top perspective view of an exemplary embodiment of a table, illustrating the legs in an extended position.

As shown in FIG. 1, an exemplary embodiment of the table 10 includes a table top 12. The table top 12 is preferably constructed from a lightweight material such as plastic. In particular, the table top 12 can be constructed from plastic, such as high density polyethylene, but other materials with suitable characteristics may also be used to construct the table top. The plastic table top 12 is desirably formed by a blow-molding process because, for example, it may allow a relatively strong, lightweight, rigid and sturdy table top to be quickly and easily manufactured. In particular, the blow molded table top 12 may be relatively lightweight because it may include a hollow interior portion. In addition, the blow molded plastic table top 12 may be constructed from less plastic than conventional plastic table tops, which may save manufacturing costs and reduce consumer costs. Further, the blow-molded table top 12 can be manufactured with relatively thin outer walls, which may allow the table top to cool more quickly during the manufacturing process and that may decrease both manufacturing time and costs.

The blow-molded plastic table top 12 can be constructed to form a variety of suitable shapes, configurations, sizes, designs and/or colors depending, for example, upon the intended use of table 10. For example, as shown in FIGS. 1–3, the table top 12 can be constructed with a generally rectangular configuration and it may be used to create a utility table. The utility table may have a length of four, six or eight feet and a width of about two or three feet. One of ordinary skill in the art will appreciate that the table top 12 can have other suitable sizes and configurations. For example, the table top can have a circular configuration with a diameter of about five feet or a generally square configuration with sides two to four feet in length. Of course, the blow-molded table top 12 can have any suitable size and configuration depending, for example, upon the intended use of the table 10.

The table top 12 is preferably constructed from blow molded plastic because the blow molded plastic table tops may be durable, weather resistant and temperature insensitive. In addition, the blow molded table top 12 may be generally corrosion resistant, rust resistant and it generally does not deteriorate over time. One skilled in the art, however, will appreciate that the table top 12 does not have to be constructed from blow-molded plastic and other suitable materials and/or processes can be used to construct the table top depending, for example, upon the intended use of the table 10. For example, the table top 12 could be constructed from other suitable types of plastic and the table top could be constructed using other suitable processes such as injection molding, extrusion molding, compression molding and the like.

As shown in the accompanying figures, the table top 12 preferably has a generally planar construction. For example, the table top 12 may have a generally planar upper surface, which may allow the table to be used in a wide variety of situations and environments. The table top 12 may also have a lower surface that is spaced apart from the upper surface. Preferably the upper surface and the lower surface are spaced apart at a generally constant distance and both the upper and lower surfaces have a generally planar construction. In particular, neither the upper surface nor the lower surface of the table top 12 includes any outwardly extending projections, such as a lip. Advantageously, the generally planar upper and lower surfaces may allow the table top 12 to be quickly and easily manufactured, which may decrease the manufacturing costs of the table 10. Further, the generally planar upper and lower surfaces of the table top 12 may reduce the amount of materials required to construct the table top, which may also decrease the manufacturing costs of the table 10. Because the table 10 may be manufactured at lower costs, the may decrease the price of the table to the consumer. While the table top 12 preferably has a generally planar upper and lower surface, the table top may include one or more inwardly or outwardly extending portions. For example, as discussed below, the table top 12 may include one more depressions. In addition, if desired, the table top 12 could include one or more outwardly extending portions, such as a generally downwardly extending lip, that may be formed in or attached to any desired portion of the table top.

The table top 12 may include one or more features that are integrally formed in the table top as part of a unitary, one-piece structure. For example, the table top 12 may include one or more recesses formed in the lower surface of the table top, which may be sized and configured to receive at least a portion of a table legs in the collapsed or storage position. Advantageously, this may facilitate stacking of the tables 10 and/or securing the table legs in the collapsed position. Also, as an example, one or more depressions may be integrally formed in the table top 12 as part of a one-piece construction. The depressions, for example, may be sized and configured to increase the strength and structural integrity of the table top 12. The depressions may extend from one surface of the table top 12, such as the bottom surface, to an opposing surface, such as the top surface. The depressions may contact or engage the opposing surface, but the ends of the depressions could be spaced apart from the opposing surface. The depressions may advantageously be sized to permit thinner, yet stronger, walls to be constructed. The thinner walls may be used to create a table top 12 that cools faster during the manufacturing process and requires less plastic to manufacture. This may allow a lightweight table top 12 to be constructed, which may decrease the weight of the table 10. It will be appreciated that the table top 12 could have any suitable number of features, but the table top does not require any particular features or number of features.

Figure 2A:
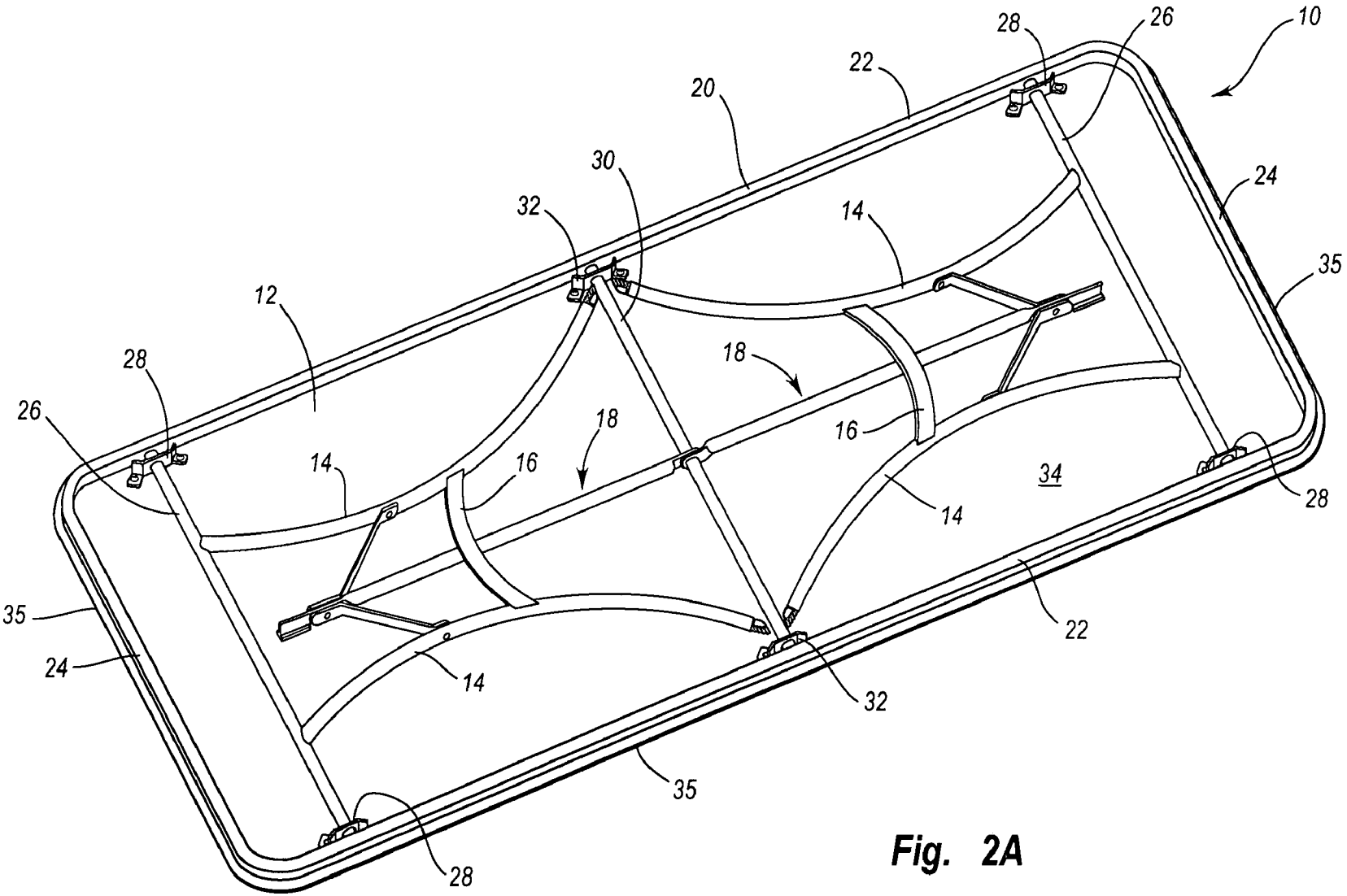
FIG. 2A is a bottom perspective view of the table shown in FIG. 1.
Figure 2B:
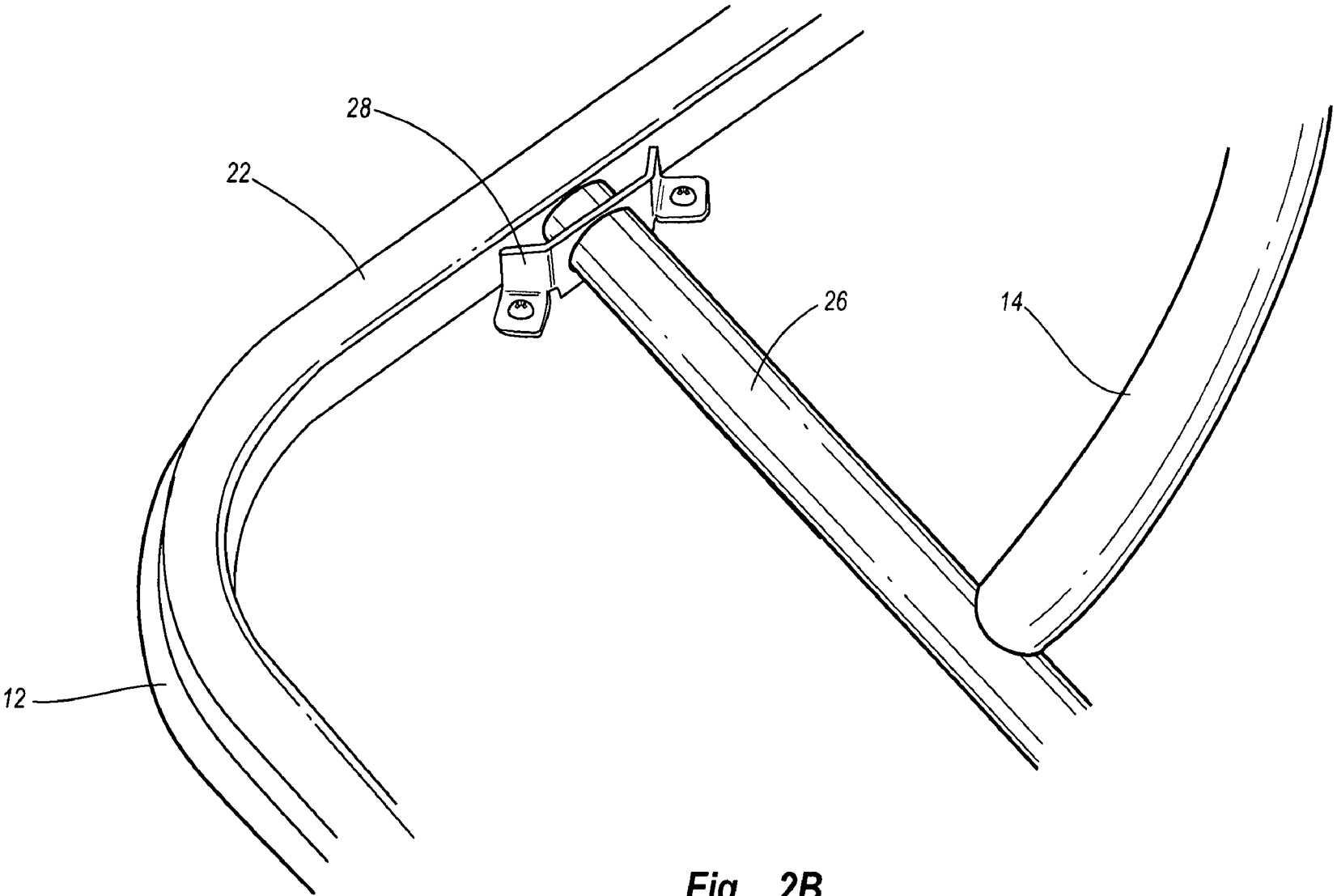
FIG. 2B is an enlarged bottom perspective view of a portion of the table shown in FIG. 2A.
Figure 3A:
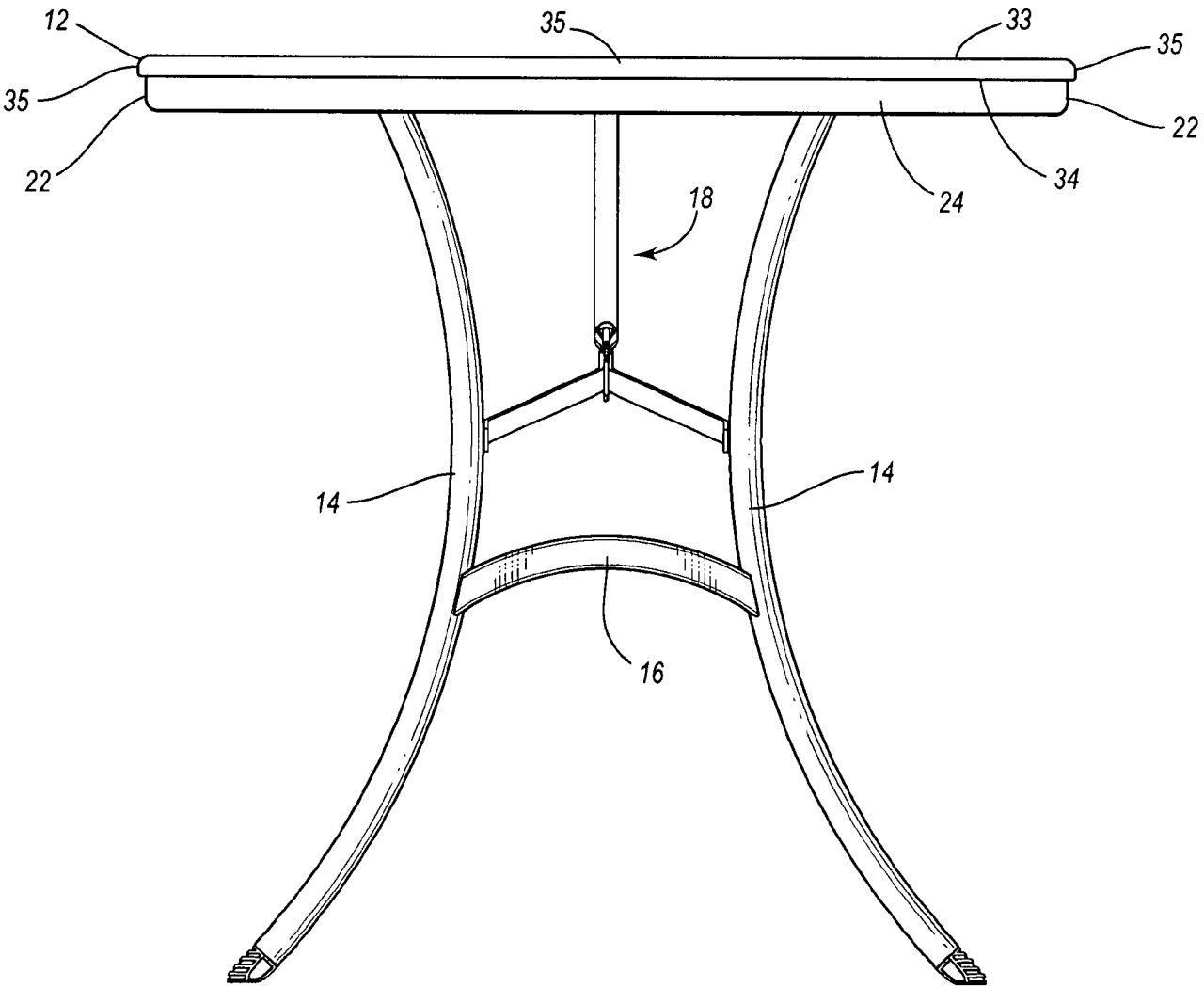
FIG. 3A is a side view of the table shown in FIG. 1.
Figure 3B:
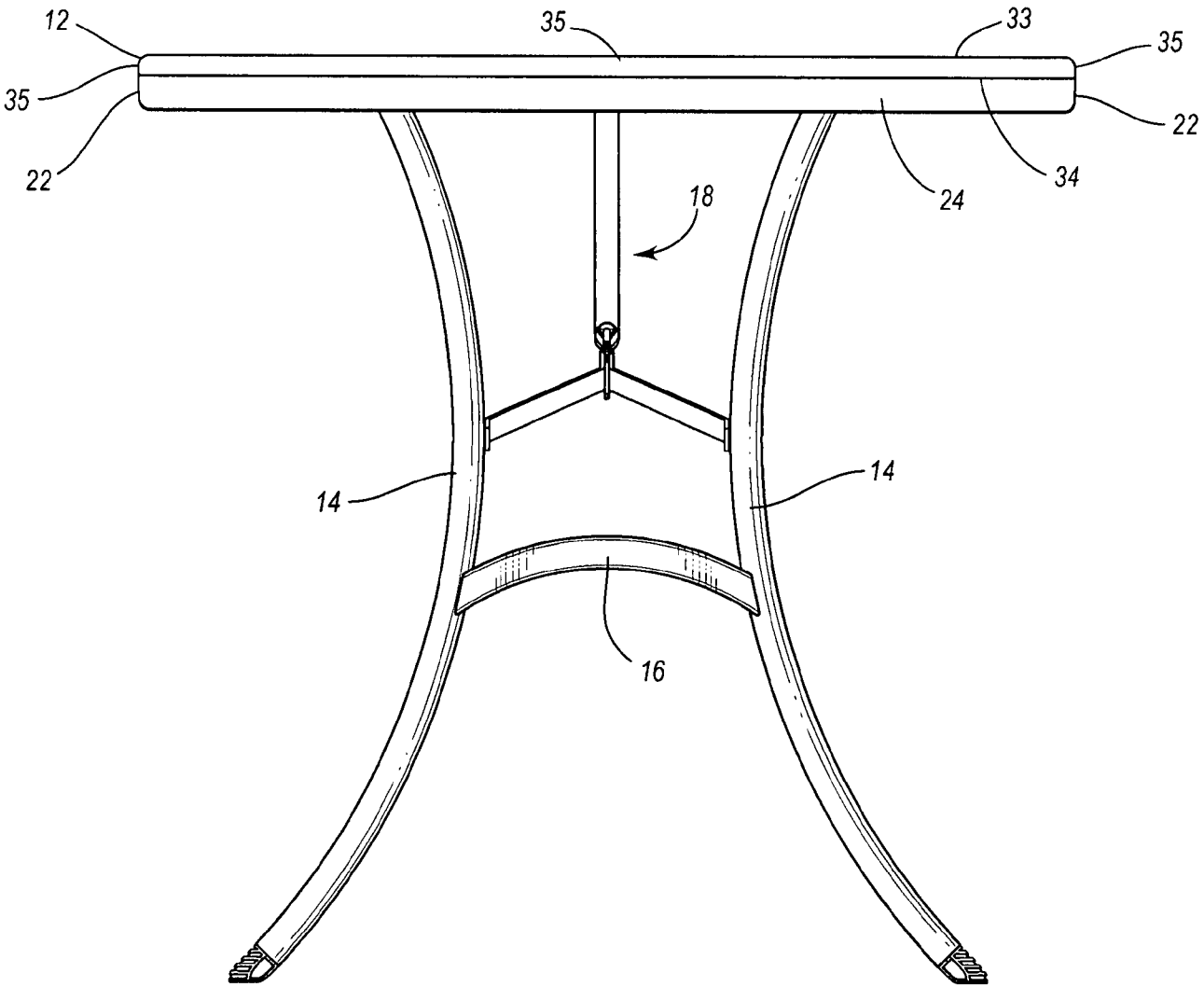
FIG. 3B is a side view of another exemplary table, illustrating the side rails of the frame generally aligned with the edges of the table top.

As shown in FIGS. 1–3, the table 10 may include one or more legs or supports 14 and the legs are preferably movable between an extended or use position (shown in FIGS. 1 and 3) and a collapsed or storage position (shown in FIG. 2A). The legs 14 may include a pair of elongated portions or bodies, and the elongated portions may be interconnected if desired. For example, the elongated portions of the legs 14 may be interconnected by a cross brace 16, which may increase the stability of the legs 14 and may allow the legs to be quickly and easily moved between the extended and collapsed positions. The legs 14, however, do not have to be interconnected by the cross brace 16 and the legs could have any suitable size, configuration and/or design.

The table 10 may also include a frame 20 and the frame may include one or more side rails. For example, the frame 20 may include one or more side rails 22 that are disposed along the sides or edges of the table top 12. The side rails 22 preferably extend along a length of the table top 12 and the side rails preferably extend at least a majority of the length of the table top. The side rails 22 are preferably generally aligned with the edges of the table top 12. In particular, the side rails 22 are preferably generally parallel to or disposed generally in the same plane as the outer edges of the table top 12. The side rails 22, however, could be spaced apart from the outer edges of the table top 12. For example, the side rails 22 may be spaced apart from the outer edges of the table top 12 to allow the table 10 to be more easily grasped or lifted by a user.

The side rails 22 are also preferably disposed about the perimeter or outer edges of the table top 12. Advantageously, because the side rails 22 may be disposed along the outer edges of the table top 12, the frame 20 may help support the edges or extremities of the table top. This may allow a stronger table top 12 to be formed because the edges of the table top may be supported by the frame 20. In addition, the frame 20 may help prevent damage to the table top 12. For example, the frame 20 may help prevent the table top 12 from undesirably bending or deforming if a force or sudden impact is applied to an edge of the table top. In addition, the frame 20 may help absorb various forces and/or prevent items from striking the table top 12.

Advantageously, if the side rails 22 are disposed proximate the edges of the table top 12, then that may allow wider legs 14 to be attached to the table 10. For example, if the side rails 22 are generally aligned with the outer edges of the table top 12, then the legs 14 may have a width that is approximately equal to or slightly less than the width of the table top. Thus, for example, the legs 14 could include two support portions that are disposed proximate the edges of the table top 12 and the support portions could be separated by a distance that is approximately equal to or slightly smaller than the width of the table top. The legs 14 could also have a foot that has a length that is approximately equal to or slightly smaller than the width of the table top 12. Advantageously, because the legs 14 may have a width and/or a foot that has a length that is approximately equal to the width of the table top 12, that may allow a very sturdy and stable table to be created.

The frame 20 may also include connecting portions 24 that are preferably disposed proximate the ends of the table top 12. While the connecting portions 24 are preferably disposed proximate the end of the table top 12, the connecting portions 24 may also be spaced inwardly from the end of the table top. As best seen in FIG. 2A, the connecting portions 24 may be connected to the side rails 22. The connecting portions 24 may also be integrally formed with the side rails 22 to create a unitary, one-piece frame 20. Of course, the connecting portions 24 and the side rails 22 do not have to be interconnected and the frame 20 could have other suitable shapes, sizes and configurations.

The frame 20 is preferably constructed from a relatively strong and rigid material, such as steel. Advantageously, the frame 20 may be used to support all or a portion of the table top 12. It will be appreciated, however, that the frame 20 could be constructed from other materials with suitable characteristics and the table 10 does not require the frame. In addition, while the frame 20 is preferably at least partially disposed along the exterior portions of the table top 12, the frame could be connected to any desired portions of the table top.

As shown in FIGS. 1–3, the legs 14 may be connected to (or formed integrally with) a crossbar 26 and the crossbar may allow the legs to pivot between the use and storage positions. The crossbar 26, for example, may be rotatably or pivotally attached to the lower surface of the table top 12 using the brackets 28 or other suitable fasteners. Thus, the legs 14 and/or crossbar 26 may be independently connected to the table top 12. The crossbar 26, however, may also be rotatably attached to frame 20, if desired. For example, the crossbar 26 may be connected to the frame 20 by inserting at least a portion of the ends of the crossbar into a hole, recess or other opening formed in the side rails 22 of frame. The legs 14 and/or crossbar 26 may also be attached to the table 10 by other suitable mechanisms or devices depending, for example, upon the intended use of the table 10.

The table 10 may also include one or more braces 18 that may help stabilize the table and/or guide the legs 14 between the use and storage positions. For example, as best seen in FIG. 2A, a brace 18 may be connected to each leg 14 and also to a support structure. The support structure may include a support member 30 that is disposed near the center of the table 10 and the support member may be attached to the lower surface of the table top 12 using the brackets 32 or other suitable fasteners. The support member 30 may also be attached to table frame 20 by inserting at least a portion of the ends of the support member into a hole, recess, or other opening formed in the table frame. Preferably, the brace 18 help secure legs 14 in the use position and/or help the legs pivot between the use and storage positions. It will be appreciated that other suitable types of braces 18 and support structures may be used, if desired. For example, each brace 18 could be attached to a separate support structure or other suitable portions of the table 10.

Advantageously, the crossbars 26 and/or support member 30 may be used to connect the frame 20 to the table top 12. For example, if the crossbars 26 and/or support member 30 are connected to the frame 20, and the crossbars and support member are connected to the table 12, then the frame may also be connected to the table top. For example, the crossbars 26 may be attached to the table top 12 by the brackets 28 and the support member 30 may be attached to the table top by the brackets 32. If the frame 20 is connected to the crossbars 26 and/or support member 30, then the frame may be connected to the table top by the crossbars and/or support members. Thus, if the crossbars 26 and/or support member 30 are connected to the frame 20, then the brackets 28 and 32 may be used to connect the crossbars, support members and frame to the table top 12. It will be appreciated that the frame 20, crossbars 26 and support member 30 could be connected to the table top 12 using any suitable fasteners, adhesives, or other appropriate means such as a snap, friction or interference fit.

The lower portion of the table top 12 preferably does not include any generally downwardly extending portions such as a lip. Instead, the lower or underneath portion of the table top 12 is preferably generally planar. Advantageously, this may allow the table top 12 to be more quickly and efficiently manufactured. In addition, the table top 12 may have a relatively simple and straightforward design.

The legs 14, braces 18, crossbars 26 and support members 30 are preferably constructed of a strong material, such as metal. The legs 14, crossbars 26 and support members 30 preferably have a generally hollow, tubular construction, which may decrease the weight of the table 10. Of course, legs 14, braces 18, crossbars 26 and support members 30 may be constructed of other suitable materials and may have other suitable configurations. Further, it will be appreciated that the table 10 need not include all of these components, depending, for example, upon the particular configuration of the table.

As discussed above, at least a portion of the frame 20 may be aligned with and/or parallel to the edges of the table top 12. All or a portion of the frame 20, however, may be spaced part or offset from the edges of the table top 12. For example, the side rails 22 of the frame 20 may be spaced slightly inwardly from the edges of the table top 12. This may allow, for example, a person to more easily grasp or hold the edges of the table top 12.

As best seen in FIGS. 1–3, all or at least a portion of the frame 20 is preferably exposed and visible to the user. That is, when the table 10 is in the use position, at least a portion of the frame 20 is exposed and visible to the user. Accordingly, the frame 20 is preferably disposed relative to the table top 12 so that at least a portion of the frame is visible to the user. Desirably, the outer portions of the side rails 22 and connecting portions 24 are visible. In particular, the outer portions of the side rails 22 and connecting portions 24 may be aligned with and/or parallel with the edges or perimeter of the table top 12 so that these portions of the frame 20 are exposed and visible to the user. It will be appreciated, however, that any desired portions of the frame 20 may be exposed or visible to the user. Advantageously, if the frame 20 is visible, the contrast between the table top 12 and the frame may be used to create a stylish or fashionable table 10. For example, because the table top 12 and frame 20 may be constructed using different materials, textures and colors, a table with a pleasing appearance may be created. In addition, the contrast between the table top 12 and the frame 20 may be used to create difference aesthetics depending, for example, upon the intended use of the table 10.

Advantageously, if at least a portion of the frame 20 is exposed, that may create the impression, whether real or imaged, that the table 10 is relatively strong. In addition, if at least a portion of the frame 20 is disposed along the outer edges of the table top 12, then the frame 20 may provide increased support for the edges or extremities of the table top. Further, if the frame 20 is disposed along the outer edges of the table top 12, then the frame may help prevent the table top from being damaged. For example, the frame 20 may absorb impacts or forces because it is disposed about the perimeter of the table top 12 that otherwise would be applied directly to the table top. Accordingly, the frame may also help protect the table top from being dented, damaged or broken.

On the other hand, the table top 12 may be sized and configured to protect some or all of the frame 20. For example, as best seen in FIG. 3, the table top 12 may have an upper surface 33, a lower surface 34, edges 35 and the side rails 22 of the frame 20 may be spaced slightly inwardly from the outer edges of the table top. With the edges 35 of the table top 12 extending past the outer portions of the frame 20, the table top may help prevent unintentional, potentially damaging contact with the table frame. For example, the exposed surfaces of the frame 20 may be painted and/or have a finished surface, and even minor impacts can leave significant scars or other visible blemishes on such surfaces. Because the table top 12 may be constructed from a durable, resilient material such as blow molded plastic, the table top may help protect the frame 20 from damage. Thus, the table top 12 may be sized and configured to minimize or otherwise reduce the visible damage to the frame 20, which helps keep the table 10 looking like new.

The table may also include one or more guards that are sized and configured to help protect the table. In particular, as shown in FIGS. 4–7, an exemplary embodiment of a table 60 includes corner guards that are sized and configured to protect the corners of the table. As shown in the accompanying figures, the table 60 includes a table top 62, which may have a similar configuration and arrangement to the table 10 discussed above. The table 60 may also include legs 64, which may be connected to (or formed integrally with) one or more feet 66. One or more end caps 68 may be optionally connected to the ends of the feet 66. The end caps 68 may be sized and configured to raise at least portion of the feet 66 above a surface and/or to grip the surface. Preferably, the legs 64 may be movably connected to the table top 62, and may be connected to the table top using one or more braces 70 or other suitable connectors or devices. Of course, table legs 64 need not be movable and could be fixed in a desired position. The table 60 may also include a frame 72, which may include one or more side rails 74. The edges of the side rails 74 may be generally aligned with the edges 76 of the table top 62 to present a generally flat outer surface. The edges of the side rails 74 and the edges 76 of the table top 62, however, could be offset if desired.

The table 60 preferably includes four corner guards 78 that are disposed in each corner of the table, but the number of corner guards may depend upon the shape and configuration of the table. The corner guards 78 may be constructed of a relatively durable material, such as plastic, and may be constructed using injection molding, rotary molding, compression molding or other suitable processes. Of course, the corner guards 78 may be constructed using other suitable materials and processes, if desired.

Figure 4:
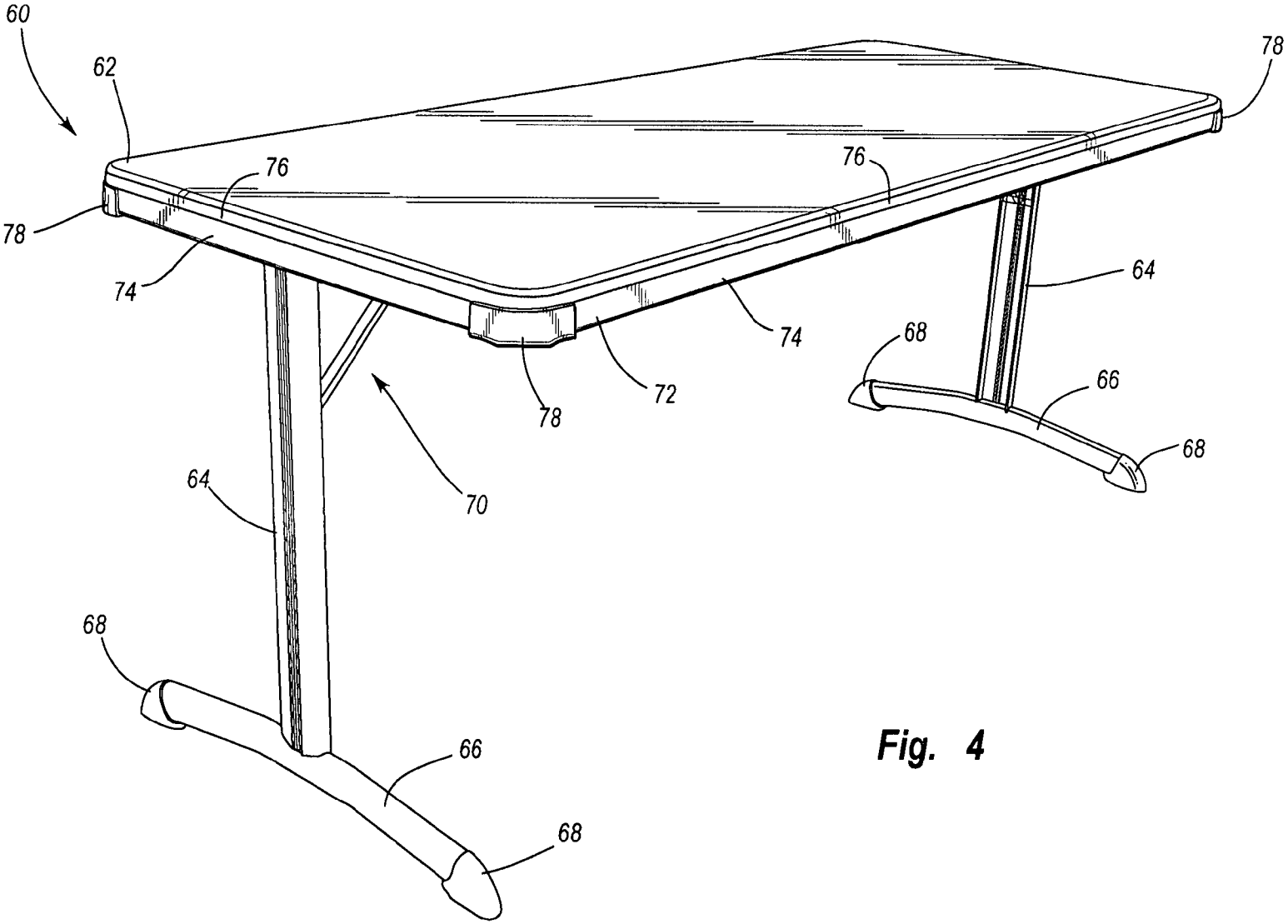
FIG. 4 is a top perspective view of another exemplary embodiment of a table, illustrating corner guards disposed at the corners of the table top.
Figure 5:
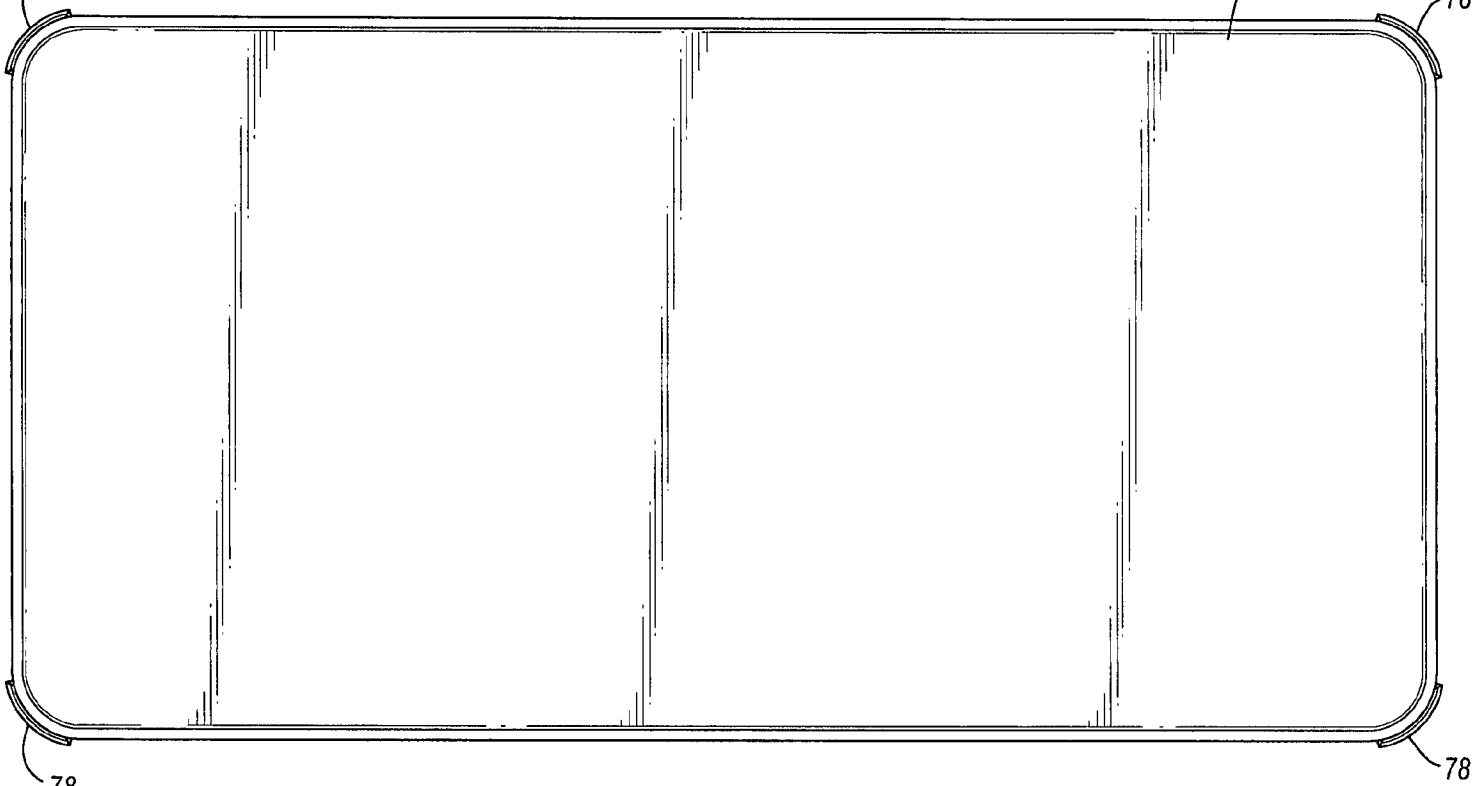
FIG. 5 is a top view of the table shown in FIG. 4.

As best shown in FIGS. 4 and 5, at least a portion of the corner guards 78 may be sized and configured to extend past the corners of the table frame 72 and/or the corners of the table top 62. Thus, the corner guards 78 advantageously may help prevent unintentional, potentially damaging contact with the table frame 72 and/or the table top 62 that can occur, for example, from dropping the table 60. In particular, the corner guards 78 may provide impact protection for the table 60. The corner guards 78 may also form a bumper or cushion that absorbs energy if forces are applied to the corner of the table 60. Thus, the corner guards 78 may help protect the table top 62 and/or table from 72 from damage.

The corner guards 78 may also be used to connect the frame 72 to the table top 62. For example, the corner guards 78 may be connected to portions of the frame 72 such as the side rails and connecting members. Advantageously, the corner guards 78 may help align and position the frame 72 in the desired position. For example, the corner guards 78 may allow the frame 72 to be aligned in the desired portion and the corner guards may assist in connecting various portions of the frame. Additionally, if desired, the corner guards 78 may connect the frame 72 to the table top 12. Thus, the corner guards 78 aid with attachment of the frame 72 to the table 10. Further, the corner guards 78 may allow the table 60 to be quickly and easily assembled. Therefore, for example, this may aid the manufacturing process and/or it may allow the consumer or retailer to assemble the table.

In addition, the corner guards 78 may be permanently or selectively attached to the table top 62 and/or frame 72. Advantageously, if the corner guards 78 are selectively attached, then that may allow the corner guards to be repaired or replaced. Significantly, this may allow a consumer, retailer or manufacturer to repair the table 60 if the corner guards are broken, worn or damaged. The corner guards 78, however, may also be an integral part of the table 60 and/or frame 72.

Figure 6:
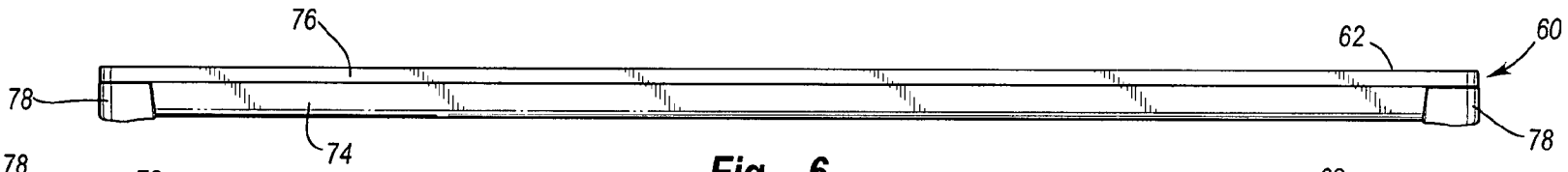
FIG. 6 is a front view of the table shown in FIG. 4.
Figure 7:
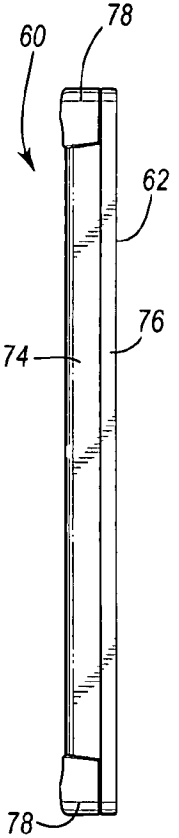
FIG. 7 is a side view of the table shown in FIG. 4.

As best seen in FIGS. 6 and 7, the lower portion of the corner guards 78 may be sized and configured to extend beyond a lower portion of the frame 72. In particular, the lower portion of the corner guards 78 may extend beyond the lower surface of the side rails 74 of the table frame 72 and, when the legs 64 are in the collapsed position, the corner guards may help prevent damage to the table 60. Thus, the corner guards 78 may help protect the lower portion of the table 60 from damage when the table legs 64 are in the collapsed position. In addition, the corner guards 78 may include a nesting feature that facilitates stacking of the tables 60. For example, the bottom portion of the corner guards 78 may be sized and configured to receive at least a portion of an adjacent table, such as a portion of the table top 62, when the tables are stacked. Thus, the corner guards 78 may act as guides to facilitate stacking of the tables 60. The corner guards 78 may also assist in aligning the tables 60 when the tables are positioned adjacent to each other.

The corner guards 78 may also help create a table 60 with an aesthetically pleasing design. For example, the corner guards 78 may create a distinction or dissimilarity between the table top 62 and the frame 72 to create a stylish or fashionable table 60. For example, because the corner guards 78, table top 62 and/or frame 72 may be constructed using different materials, textures and colors; a table with a pleasing appearance may be created. In addition, the contrast between the corner guards 78, table top 62 and the frame 72 may be used to create different designs depending, for example, upon the intended use of the table 10. It will be appreciated that while the various components of the table 60 may have different colors, textures and the like, one or more components may have the same color, texture and the like.

Figure 8:
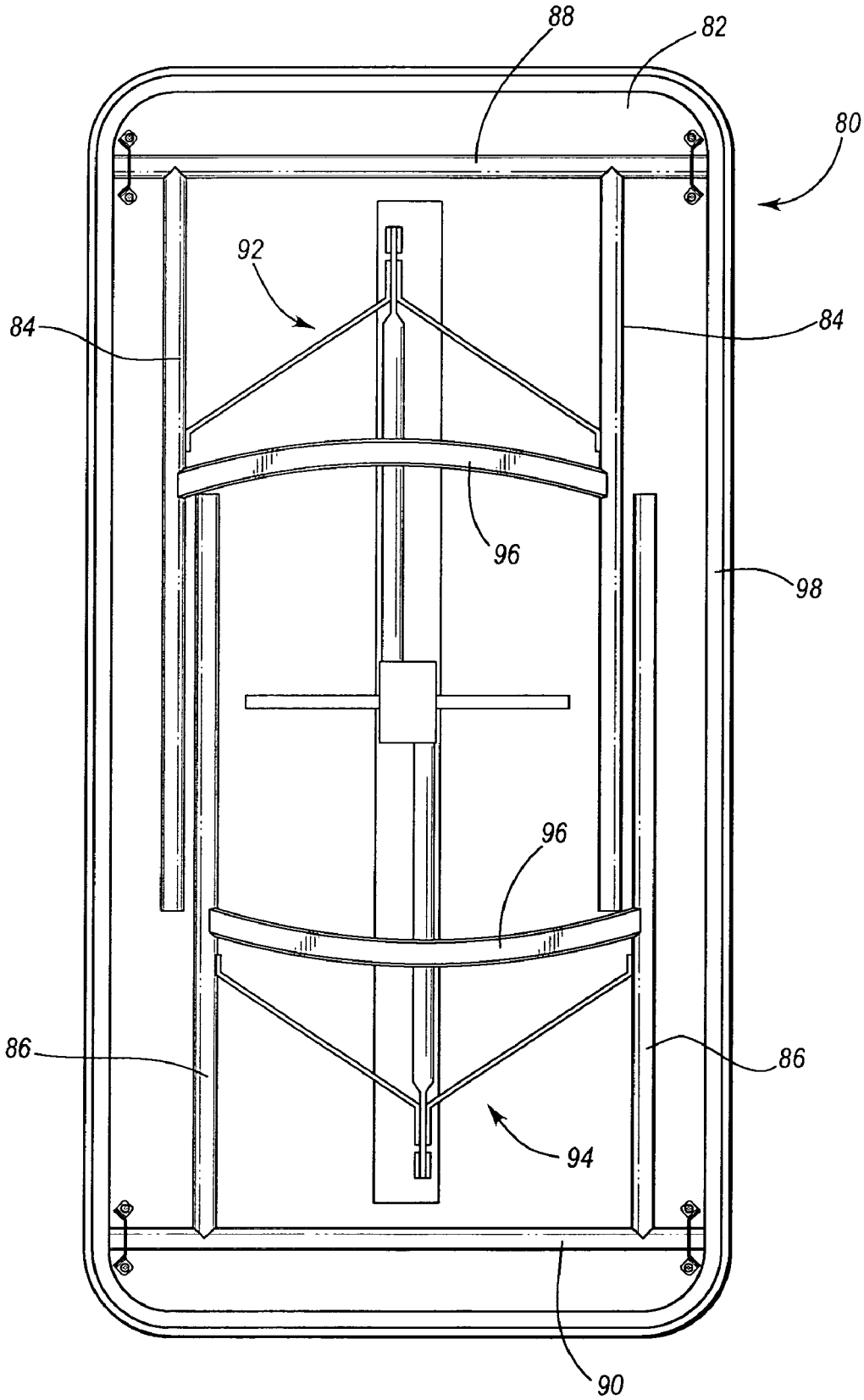
FIG. 8 is a bottom view of yet another exemplary embodiment of a table, illustrating the legs in a collapsed position.

As seen in FIG. 8, another exemplary embodiment of a table 80 includes a table top 82, which preferably has similar characteristics to the table tops 12 and 62, but it could have other suitable constructions. The table 80 may also include legs 84, 86 that are preferably movable relative to the table top 82 between a collapsed position and an extended position. The legs 84, 86 may be connected to (or formed integrally with) one or more crossbars 88, 90 respectively, and the crossbars are preferably pivotally connected to the table top 82 by braces 92, 94 and/or other suitable connectors or devices. Each of the legs 84, 86 may include two elongated portions that are spaced apart. Each of the legs 84, 86 may also include connecting members 96 that interconnect the legs. Of course, legs 84, 86 do not have to be movable relative to the table top 82 and the legs could secured to the table top in a fixed position. As shown in FIG. 8, the legs 84, 86 have a generally straight configuration but the legs may have curvilinear or other suitable shapes (such as, the legs 14 in FIGS. 1–3). The legs 84, 86 may also be offset to permit longer legs to be constructed, which provides for a taller table to be provided. It will be appreciated that the legs 84, 86 may have other desirable shapes and configurations depending, for example, upon the intended use of the table.

One skilled in the art will also appreciate that although the exemplary embodiments discussed above have been described with respect to tables, these aspects and features may also be used in connection with other types of furniture such as chairs, stools, footstools, or any other suitable type of devices or fixtures.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:

a table top constructed from blow molded plastic and including a hollow interior portion that is formed during the blow molding process, the table top including a first side and an opposing second side;

a frame including a first side rail with an outer surface and a second side rail with an outer surface, the outer surface of the first side rail being generally aligned with the first side of the table top, the outer surface of the second side rail being generally aligned with the second side of the table top;

at least one support member movable relative to the table top between an extended position in which the support member generally extends outwardly from the table top and a collapsed position in which the support member is generally positioned between the side rails of the frame; and at least one cross bar connecting the at least one support member to the table top and connecting the frame to the table top.

2. A table comprising:

a table top constructed from blow molded plastic and including a hollow interior portion that is formed during the blow molding process, the table top including an upper surface, a lower surface, a first side, a second side, first end and a second end;

a first support member movable relative to the table top between a first position in which the first support member extends outwardly from the table top and a second position in which the first support member is positioned proximate the lower surface of the table top;

a second support member movable relative to the table top between a first position in which the second support member extends outwardly from the table top and a second position in which the second support member is positioned proximate the lower surface of the table top;

a first side rail generally aligned with the first side of the table top;

a second side rail generally aligned with the second side of the table top;

a first end rail generally aligned with the first end of the table top;

a second end rail generally aligned with the second end of the table top;

a first guard member connecting the first side rail and the first end rail;

a second guard member connecting the second side rail and the first end rail;

a third guard member connecting the first side rail and the second end rail;

a fourth guard member connecting the second side rail and the second end rail; and a first crossbar connecting the first support member to the table top and a second crossbar connecting the second support member to the table top, the first crossbar and the second crossbar connecting the first side rail and the second side rail to the table top.

3. A table comprising:

a table top constructed from blow molded plastic and including a hollow interior portion that is formed during the blow molding process, the table top including an upper surface, a lower surface, a first side, a second side, a first end and a second end;

a first support member movable relative to the table top between a first position in which the first support member extends outwardly from the table top and a second position in which the first support member is positioned proximate the lower surface of the table top;

a second support member movable relative to the table top between a first position in which the second support member extends outwardly from the table top and a second position in which the second support member is positioned proximate the lower surface of the table top;

a first side rail generally aligned with the first side of the table top;

a second side rail generally aligned with the second side of the table top;

a first end rail generally aligned with the first end of the table top;

a second end rail generally aligned with the second end of the table top;

a first guard member connecting the first side rail and the first end rail to the table top;

a second guard member connecting the second side rail and the first end rail to the table top;

a third guard member connecting the first side rail and the second end rail to the table top; and a fourth guard member connecting the second side rail and the second end rail to the table top.

4. A table comprising:

a table top constructed from blow molded plastic and including a hollow interior portion that is formed during the blow molding process, the table top including an upper surface, a lower surface, a first side, a second side, a first end and a second end;

a first support member movable relative to the table top between a first position in which the first support member extends outwardly from the table top and a second position in which the first support member is positioned proximate the lower surface of the table top;

a second support member movable relative to the table top between a first position in which the second support member extends outwardly from the table top and a second position in which the second support member is positioned proximate the lower surface of the table top;

a frame constructed from metal, the frame comprising:

a first side rail generally aligned with the first side of the table top;

a second side rail generally aligned with the second side of the table top;

a first end rail generally aligned with the first end of the table top; and a second end rail generally aligned with the second end of the table top;

a first guard member constructed from plastic and a process other than blow-molded plastic, the first guard member connected to the first side rail and the first end rail;

a second guard member constructed from plastic and a process other than blow-molded plastic, the second guard member connected to the second side rail and the first end rail;

a third guard member constructed from plastic and a process other than blow-molded plastic, the third guard member connected to the first side rail and the second end rail; and a fourth guard member constructed from plastic and a process other than blow-molded plastic, the fourth guard member connected to the second side rail and the second end rail.

* * * * *

UNITED STATES PATENT AND TRADEMARK OFFICE

CERTIFICATE OF CORRECTION

PATENT NO. : 7,178,468 B2
APPLICATION NO. : 10/949777
DATED : February 20, 2007
INVENTOR(S) : Winter et al.

It is certified that error appears in the above-identified patent and that said Letters Patent is hereby corrected as shown below:

Column 1
Line 62, after "table", change "to" to --may--

Column 3
Line 49, change "advantageously" to --advantageous--

Column 7
Line 32, change "the may" to --this may--

Column 11
Line 57, change "table from 72" to --frame 72--

Signed and Sealed this

Eighteenth Day of September, 2007

JON W. DUDAS
*Director of the United States Patent and Trademark Office*